US005666093A

United States Patent [19]

D'Ostilio

[11] Patent Number: 5,666,093

[45] Date of Patent: Sep. 9, 1997

[54] MECHANICALLY TUNABLE CERAMIC BANDPASS FILTER HAVING MOVEABLE TABS

[76] Inventor: James Phillip D'Ostilio, 1110 Fidler La., Apartment 602, Silver Spring, Md. 20910

[21] Appl. No.: 514,376

[22] Filed: Aug. 11, 1995

[51] Int. Cl.[6] ..... H01P 1/202; H01P 7/04

[52] U.S. Cl. ..... 333/207; 333/224

[58] Field of Search ..... 333/202–209, 333/219, 219.1, 222, 223, 224, 227, 231, 232, 235; 361/302

[56] References Cited

U.S. PATENT DOCUMENTS

| | | | |
|---|---|---|---|
| 3,796,976 | 3/1974 | Heng et al. | 333/161 |
| 4,268,809 | 5/1981 | Makimoto et al. | 333/202 |
| 4,389,624 | 6/1983 | Aihara et al. | 333/226 |
| 4,464,640 | 8/1984 | Nishikawa et al. | 333/202 |
| 4,628,283 | 12/1986 | Reynolds | 333/219 X |
| 4,631,506 | 12/1986 | Makimoto et al. | 333/224 |
| 4,906,955 | 3/1990 | Yorita et al. | 333/207 |
| 4,912,437 | 3/1990 | Kuokkanen | 333/224 |
| 4,987,393 | 1/1991 | Yorita et al. | 333/202 |
| 5,004,992 | 4/1991 | Grieco et al. | 333/202 |
| 5,023,503 | 6/1991 | Legge et al. | 333/188 X |
| 5,028,896 | 7/1991 | Kuokkanen | 333/224 X |
| 5,150,089 | 9/1992 | Komazaki et al. | 333/206 |
| 5,160,906 | 11/1992 | Siomkos et al. | 333/204 |
| 5,218,330 | 6/1993 | Omiya et al. | 333/224 X |
| 5,225,799 | 7/1993 | West et al. | 333/202 |
| 5,227,747 | 7/1993 | Komazaki et al. | 333/206 |
| 5,304,967 | 4/1994 | Hayashi | 333/206 |
| 5,406,234 | 4/1995 | Willems | 333/203 |
| 5,420,554 | 5/1995 | Gehrke | 333/235 |
| 5,550,519 | 8/1996 | Korpela | 333/207 |

FOREIGN PATENT DOCUMENTS

| | | | |
|---|---|---|---|
| 0508733 | 10/1992 | European Pat. Off. | 333/202 DB |
| 4323902 | 11/1992 | Japan | 333/202 DB |
| 5090075 | 4/1993 | Japan | 361/302 |

*Primary Examiner*—Benny T. Lee
*Assistant Examiner*—Barbara Summons
*Attorney, Agent, or Firm*—Burns, Doane, Swecker & Mathis, LLP

[57] ABSTRACT

A mechanically tunable ceramic bandpass filter incorporates at least one resonator, the resonator including a resonator body, a coupling capacitor electrically connected to the resonator body, and an electrode pin electrically connected to the coupling capacitor and electrically isolated from the resonator body. A holding bracket fixedly supports the resonator, and is electrically connected to the resonator body. A mechanically deformable tuning tab is fixedly supported and electrically connected to the bracket at a first end. A second end of the tuning tab, variably positioned with the resonator body, forms a variable capacitor for tuning a resonant frequency of the resonator.

15 Claims, 3 Drawing Sheets

MECHANICALLY TUNABLE CERAMIC BANDPASS FILTER HAVING MOVEABLE TABS

BACKGROUND OF THE INVENTION

The present invention relates to ceramic bandpass filters for filtering microwave signals. More specifically, the invention relates to a device for mechanically adjusting the resonance frequency of the ceramic resonators in a ceramic bandpass filter.

Ceramic bandpass filters are used in electrical or electronic devices designed to process signals in the microwave frequency band. Applications for such bandpass filters include Global Positioning System (GPS) receivers, cellular telephones, wireless modems and other remote communication/signal receivers. In conventional ceramic bandpass filters, the center or operating frequency of the filter is determined by the specific application or device incorporating the filter. The ceramic resonators that go into the filters, on the other hand, are constructed with resonant frequencies that are determined by the material composition and the dimensions of the resonators.

In order to match the resonant frequencies of the ceramic resonators with the center frequency of the filters into which the resonators are incorporated, ceramic resonators are routinely modified during the manufacture of the bandpass filters. Ceramic resonators are custom-modified to their specific application. In the prior art, numerous techniques have been devised and used for modifying the resonant frequencies of ceramic resonators.

One such known technique is to grind away a portion of the resonator itself. As the ceramic resonator is ground, its resonant frequency increases. However, grinding as a technique for modifying ceramic resonators is severely limited in that it is only capable of increasing the original resonant frequency of a ceramic resonator; it is incapable of decreasing the original resonant frequency of a ceramic resonator. In addition, grinding is an irreversible process. If a resonator is erroneously ground to a higher resonant frequency, that resonator can never be modified to obtain the lower resonant frequency that was actually desired. The process of grinding ceramic resonators is known as a unidirectional form of tuning a resonator.

Due to the fact that grinding is unidirectional and irreversible, there is a great potential for waste whenever grinding is used in the manufacture of bandpass filters. Bandpass filters in general are simple, conventional devices that, as noted above, have a wide range of applications. Consequently, bandpass filters are produced in extremely large quantities, in excess of several million each year. If a tuning error were to occur in a unidirectional production process, for example by an incorrectly selected center frequency or by a mis-calibrated piece of equipment, large quantities of ceramic resonators would be incorrectly and irreversibly tuned.

Since the ceramic resonators are custom-modified to a specific application, such quantities of incorrectly ground resonators are not necessarily adaptable to other applications. An application calling for the specific resonant frequency at which the resonators were set would have to be readily available in order for the resonators to be used. In addition, resonators by virtue of their construction are not easily recyclable. Considerable time and expense would have to be put into the recycling and reprocessing of the resonators' component materials. As a whole, mistakes in the grinding of ceramic resonators are costly both in raw materials and man-hours of work.

Conventional methods for avoiding the overgrinding of ceramic resonators include using extremely accurate and tightly controlled grinding equipment, and/or grinding the resonators very slowly with close monitoring of the process. Both solutions are costly. Using accurate and tightly controlled grinding equipment requires substantial capital investment in such equipment. Grinding the resonators very slowly with close monitoring slows down production and increases the cost per unit of the resonators. All in all, the methods employed to solve the problems associated with grinding result in additional expense in both equipment and man-hours of work.

Various alternative techniques to grinding have been proposed in the prior art. One such technique is the use of adjusting screws that when positioned with ceramic resonators operate as variable capacitors. This technique is embodied in the devices of U.S. Pat. Nos. 4,268,809 to Makimoto et al.; 4,389,624 to Aihara et at.; 4,628,283 to Reynolds; 4,631,506 to Makimoto et at.; and 5,406,234 to Willems. Though the use of adjusting screws may provide effective means for adjusting the resonant frequencies of the resonators, adjusting screws introduce several notable limitations to the structure and manufacture of resonators using them. First, adjusting screws and the corresponding threaded holes into which the screws are inserted, by the nature of their construction, can only be made so small before they become prohibitively costly and difficult to handle, for example 0.060 in. diameter. As such, using adjusting screws limits the degree to which the overall size of the bandpass filter using the resonator(s) can be minimized. On the other hand, by using a larger adjusting screw, one can increase the range that the resonant frequency can be adjusted. This in turn favors the use of larger screws, but has the drawback of increasing the overall size of the bandpass filter.

Second, adjusting screws are vulnerable to shifting and/or changing position, unless permanently set using a nut, cement or other fixative material. For example, excessive vibration or rough handling may cause the adjusting screws to rotate or fall out of place. Both the placing of a nut with a small adjusting screw, and the applying of a cement or fixative material introduce additional steps into the manufacturing process that increase the cost. Additional materials and components are needed, more man-hours of work are required per unit, and additional equipment must be incorporated to automate those steps. In addition, such steps limit the overall size and design of the bandpass filters. In other words, the bandpass filters would have to be large and accessible enough for the adjusting screws to be inserted, and for either cement or fixative material to be applied to the screws. Due to the limitations discussed above, the use of adjusting screws is not a viable alternative to grinding, especially for applications that demand the miniaturization of components to the greatest degree possible.

Another technique known in the prior art is the use of frequency adjusting devices formed using semiconductor-like processes. For example, U.S. Pat. Nos. 4,987,393 to Yofita et al. and 5,004,992 to Grieco et al. show base plates on which electrode patterns are formed using photolithography. The dimensions of the electrode patterns determine the resonant frequencies of the resonators.

U.S. Pat. Nos. 5,227,747 to Komazaki et al. and 5,304,967 to Hayashi show dielectric blocks or plates that also have electrode patterns formed on them. In order to adjust the resonant frequencies of the resonators, portions of the electrode patterns are etched or trimmed away.

Like the use of adjusting screws, electrode patterns on base or dielectric plates may provide effective means for adjusting the resonant frequencies of the resonators, but nonetheless introduce their own distinct limitations. In particular, if the adjustment of the resonant frequencies is limited to simply attaching a dielectric plate with a prefabricated pattern on it, there is no simple adjustment of the resonant frequencies. Rather, the resonant frequency is determined by the electrical characteristics of the dielectric plate and electrode pattern in combination with the resonators. Using this procedure would require that the process for forming the electrode patterns on the dielectric plates be closely coordinated with the manufacture and/or inspection of the resonators actually used in order to assure that the desired resonant frequencies will result. This procedure increases the per unit cost of the filters by virtue of the added procedures for coordinating the manufacture of the components, and slow down the manufacture of the filters.

If, however, procedures and equipment are added to allow the electrode patterns to be etched or trimmed during manufacture of the filters, the cost of the filters increases due to added time and equipment for etching or trimming the electrode patterns. The etching and trimming of electrode patterns can be either labor intensive, if using technicians equipped and trained to modify electrode patterns, or automated, if using computerized manufacturing equipment. However, either alternative will involve considerable expenditures and highly specialized techniques.

In addition, the electrode pattern process is irreversible. If the resonant frequency set by the etching is not the desired frequency, the electrode pattern cannot be restored. Again, like grinding, the etching or trimming of electrode patterns is a unidirectional form of tuning the resonant frequency of the resonators. As a whole, the use of semiconductor-like processes as discussed above also falls to provide a viable alternative to grinding.

SUMMARY OF THE INVENTION

The present invention embodies a mechanically tunable ceramic bandpass filter that in one aspect incorporates a resonator; a grounding element electrically connected to the resonator; and a mechanically deformable tuning tab proximate the resonator and the grounding element, where the tuning tab forms a variable capacitor connected parallel to the resonator. Alternatively, the bandpass filter incorporates input and output resonators electrically connected to each other; a grounding element electrically connected to the input and output resonators; and first and second mechanically deformable tuning tabs proximate the input and output resonators, respectively, and the grounding element. The first and second tuning tabs form first and second variable capacitors connected parallel to the input and output resonators, respectively.

In a second aspect, a mechanically tunable ceramic bandpass filter according to the present invention incorporates at least one resonator, the resonator including a resonator body, a capacitive element electrically connected to the resonator body, and an electrode pin electrically connected to the capacitive element and electrically isolated from the resonator body. A holding bracket supportively holds the resonator, and is electrically connected to the resonator body. A mechanically deformable tuning tab is fixedly supported and electrically connected to the bracket at a first end. A second end of the tuning tab variably positioned with the resonator body forms a variable capacitance for tuning a resonant frequency of the resonator.

In a third aspect, the present invention embodies a tunable bandpass filter that comprises at least one resonator, the resonator including a coaxial transmission element, the resonator having a predetermined resonant frequency and first and second ends, a coupling capacitor having first and second ends, and an electrode electrically connected to the first end of the coupling capacitor, the coupling capacitor being electrically connected at the second end to the first end of the coaxial transmission element. A grounding bracket for fixedly supporting the resonator, is electrically connected to the second end of the coaxial transmission element, and is electrically connectable to ground. A variably deformable tuning tab having first and second ends is electrically connected at its first end to the holding bracket. The second end of the tuning tab variably positioned with the first end of the coaxial transmission element forms a variable capacitance for tuning the predetermined resonant frequency of the coaxial transmission element.

In either the second or third aspects of the invention at least, a variation of the invention consists of input and output resonators where each resonator is electrically connected to the grounding element or holding bracket, the input and output resonators are electrically connected to each other, and the grounding element is electrically connectable to ground. First and second mechanically deformable tuning tabs are each fixedly supported and electrically connected to the grounding element at first ends thereof. A second end of each of the first and second tuning tabs is variably positioned with the input and output resonators, respectively, thereby forming input and output variable capacitors parallel to the input and output resonators, respectively, for tuning the resonant frequencies.

In a fourth aspect of the present invention, a device for tuning a resonant frequency of a bandpass filter is incorporated in a bandpass filter that includes at least one resonator, the resonator including a resonator body, a coupling capacitor electrically connected to the resonator body, and an electrode pin electrically connected to the coupling capacitor and electrically isolated from the resonator body, and a holding bracket for fixedly supporting the resonator, the bracket being electrically connected to the resonator body. The device itself embodies a mechanically deformable tuning tab fixedly supported and electrically connected to the bracket at a first end thereof, wherein a second end of the tuning tab variably positioned with the resonator body forms a variable capacitance for tuning a resonant frequency of the resonator.

A main object of the present invention in all its aspects described above is to provide a device for adjusting the resonant frequencies of resonators incorporated in bandpass filters that overcomes the limitations in the prior art. In particular, the present invention is directed to a device that allows the reversible tuning of the resonant frequency in the resonator(s) of a microwave bandpass filter. In other words, if the resonant frequency of a resonator is initially adjusted up too high above the desired frequency, the resonant frequency can be adjusted down to the desired frequency. This is known as bidirectional tuning. As a consequence of the present invention's bidirectional tuning capability, the potential waste of material and manhours encountered with conventional unidirectional tuning techniques is avoided.

A second main object of the present invention is to provide a device for the bidirectional tuning of the resonant frequency in the resonator(s) of bandpass filters that is simple in design, yet capable of accurately tuning the resonant frequency within required tolerances. As implemented in the present invention, the tuning or adjusting of the resonant frequency of a resonator is done using a mechanical tab that is plastically deformed. Specifically, the resonator is connected between a coupling capacitor and ground. The tuning tab is connected to ground, and forms a variable capacitor with the coupling capacitor and an air gap between them. This variable capacitor is electrically connected in parallel to the resonator.

The tuning tab's material composition (e.g., brass or cold rolled steel) allows plastic/mechanical deformation. In other words, the tab can be bent backwards or forwards, thereby varying the distance of the air gap. Also by virtue of its material composition, when the tab is bent, it will remain in its bent position with little elastic deviation. As a result, the tuning tab's position can be set accurately within acceptable tolerances, which in turn means that the resonant frequency of the resonator can be set accurately within acceptable tolerances.

Further, since the tuning tab when bent will remain in position with little deviation, no additional steps or materials are necessary to guard against the tab being misaligned. The holding bracket of the bandpass filter that surrounds the tuning tab is more than sufficient to prevent contact with elements that may cause the tab to be pushed or bent out of position. Unlike adjusting screws, the tuning tab does not require any supporting elements such as nuts, cement or fixative materials.

Another advantage of the tuning tab is that its bending, i.e. its tuning, may be accomplished using techniques that are not extremely sophisticated as to require very specialized equipment, such as laser trimming devices or etching stations for semiconductors. At the same time, the tuning of the tab is nonetheless accurate within acceptable tolerances. Due to the simplicity of using tuning tabs, the techniques for bending the tabs are easily incorporated into the manufacturing process of the bandpass filter.

In all the present invention's aspects as discussed above and as will be further described hereafter, the invention offers numerous features and advantages that none of the devices in the prior art are capable of achieving.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
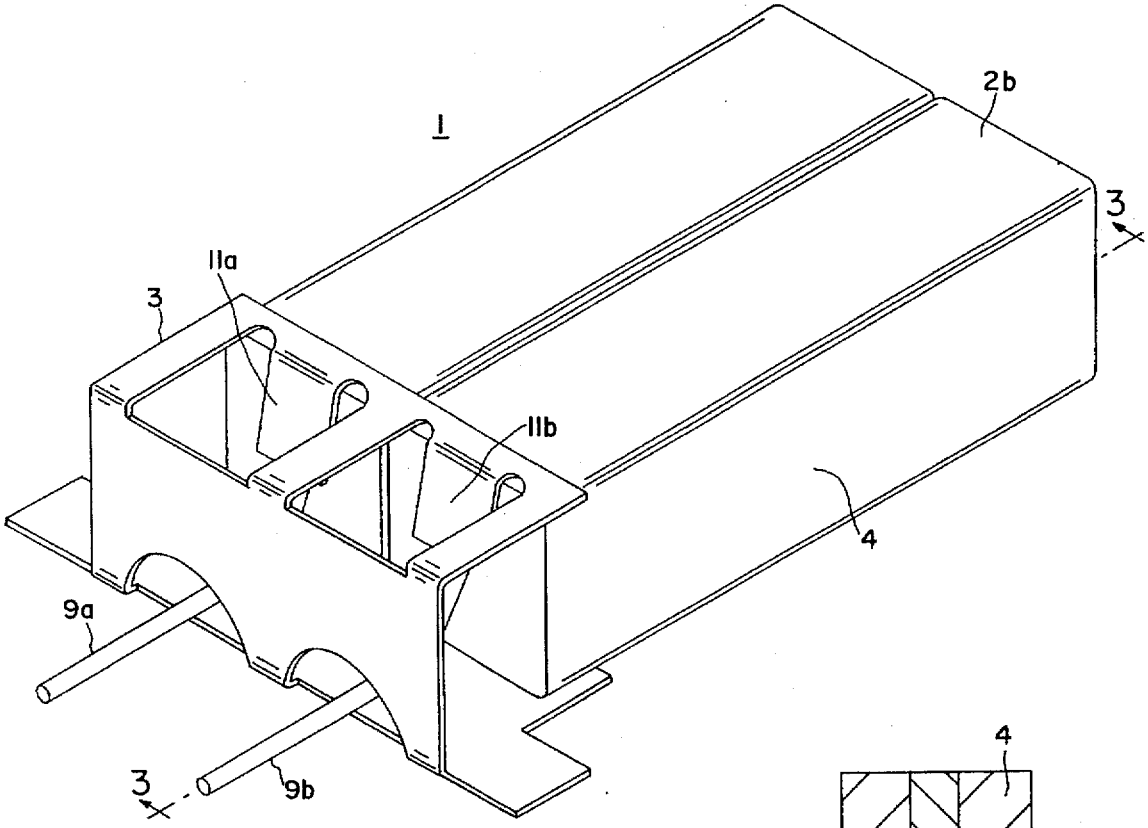
FIG. 1 shows a perspective view of a ceramic bandpass filter according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 2:
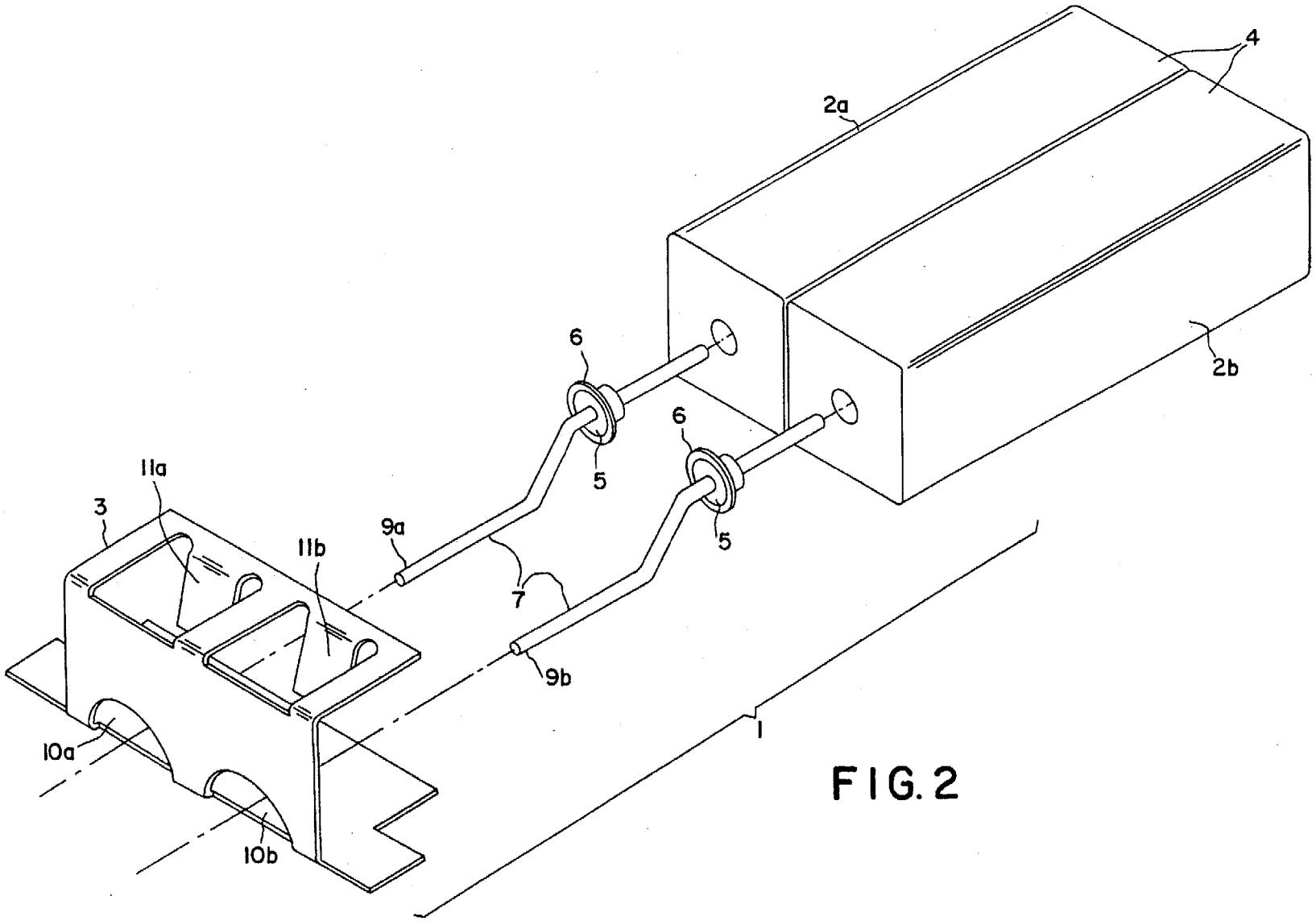
FIG. 2 shows an exploded perspective view of the ceramic bandpass filter according to the present invention.

FIGS. 1 and 2 illustrate a two-pole bandpass filter, which is one embodiment of the present invention. As shown, a mechanically tunable ceramic bandpass filter 1 according to this one embodiment incorporates two dielectric resonators 2*a*, 2*b* and a holding bracket 3 for holding the resonators 2*a*, 2*b* in place. One resonator 2*a* operates as the input, while the other resonator 2*b* acts as the output. Each of the resonators 2*a* or 2*b* includes a ceramic dielectric resonator body 4, a capacitive insert 5, a spacer flange 6, and an electrode pin 7. In this embodiment, each resonator 2*a* or 2*b* is equivalent to a ¼ wavelength coaxial transmission line.

Figure 3:
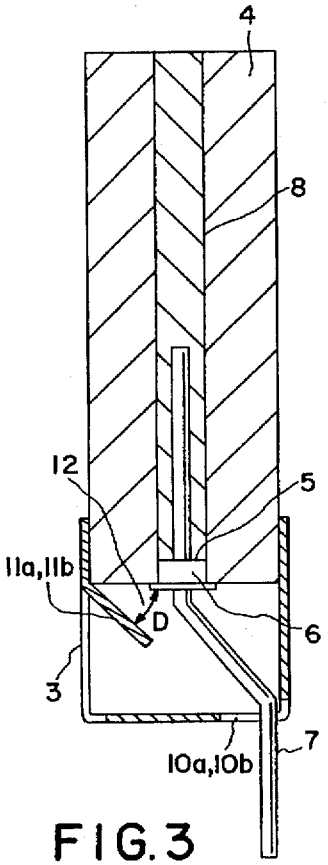
FIG. 3 shows a cross-sectional view of a resonator fitted with a mounting bracket that has a tuning tab along VIEW 1—1 in accordance with the present invention.

As shown in the cross-sectional view of FIG. 3, the capacitive insert 5 operating as a coupling capacitor is positioned in a cylindrical cavity 8 defined in the resonator body 4. The spacer flange 6 is positioned to hold the electrode pin 7 in place in the resonator body 4 with one end of the pin 7 in the cavity 8 and surrounded by the capacitive insert 5. In this embodiment, the spacer flange 6 holds the electrode pin 7 in place with glass filling the gap between them. The spacer flange 6 is thus electrically isolated from the electrode pin 7. The opposite ends of each pin 7 act as terminals 9*a*, 9*b* for the resonators 2*a*, 2*b* (See FIG. 1). The holding bracket 3 is positioned to support the ends of the resonators 2*a*, 2*b* from which the terminals 9*a*, 9*b* extend. In this embodiment, the bracket 3 is connected to the resonators 2*a*, 2*b* via high-temperature solder.

The holding bracket 3 is formed with terminal holes 10*a*, 10*b*; the terminals 9*a*, 9*b* are aligned and/or formed to extend out through the terminal holes 10*a*, 10*b*. The holding bracket 3 further includes tuning tabs 11*a*, 11*b*, which are formed to adjustably bend towards the spacer flange 6 of each of the resonators 2*a*, 2*b*.

Figure 4:
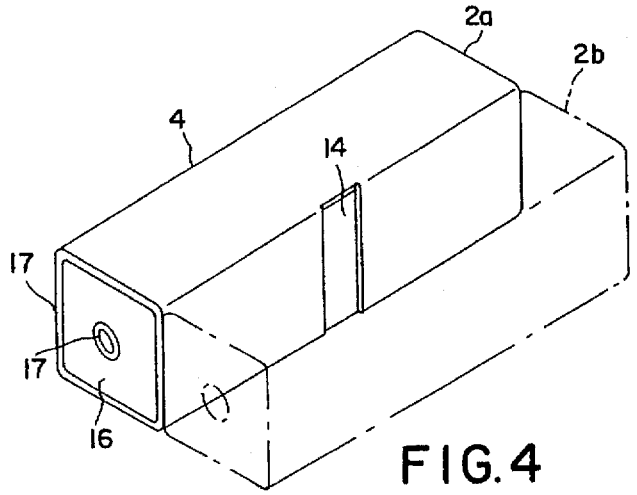
FIG. 4 shows the positioning of the coupling aperture of one resonator with the coupling aperture of a second resonator.

In this embodiment of the present invention, the resonator body 4 as illustrated in FIG. 4 is formed from ceramic material 16 with a plating 17 of silver over copper on all its surfaces, except for the surface 16 through which the cavity 8 (see FIG. 3) is defined and from which the electrode pin 7 extends. Various ceramic materials known in the art with different types of plating, e.g. tin, nickel, gold, for the resonator are usable. A coupling aperture 14 is formed on another surface of the resonator body 4. The coupling apertures 14 of the resonators 2*a*, 2*b* are aligned with each other to electrically connect the resonators together.

Further, in this embodiment, the capacitive insert 5 (see FIG. 3) is formed from glass, such as Corning 9013 or its equivalent. As known in the art, other insulators are also useful, e.g. teflon, polystyrene. To form the electrode pin 7 and spacer flange 6, a glass-to-metal feedthru element such as the feedthru element No. MP628 made by Metal Processing Co., Inc. is used. In that element, the electrode pin 7 and the spacer flange are made from cold rolled steel, with the spacer flange 6 being attached to the electrode pin 7 using glass such as Corning 9013 as a filler between them. The bracket 3 in this embodiment is formed from brass with tin plating, or cold rolled steel with tin plating. However, other types of material known in the art, such as brass plated in gold or silver, or dipped in either tin or solder, are usable.

Figure 5B:
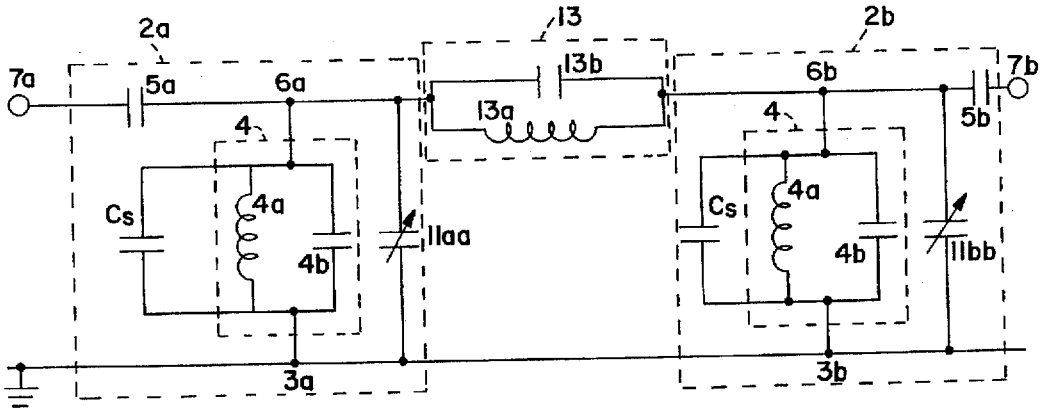
FIGS. 5A and 5B show diagrams of the equivalent circuits of a ceramic bandpass filter according to the present invention.
Figure 5A:
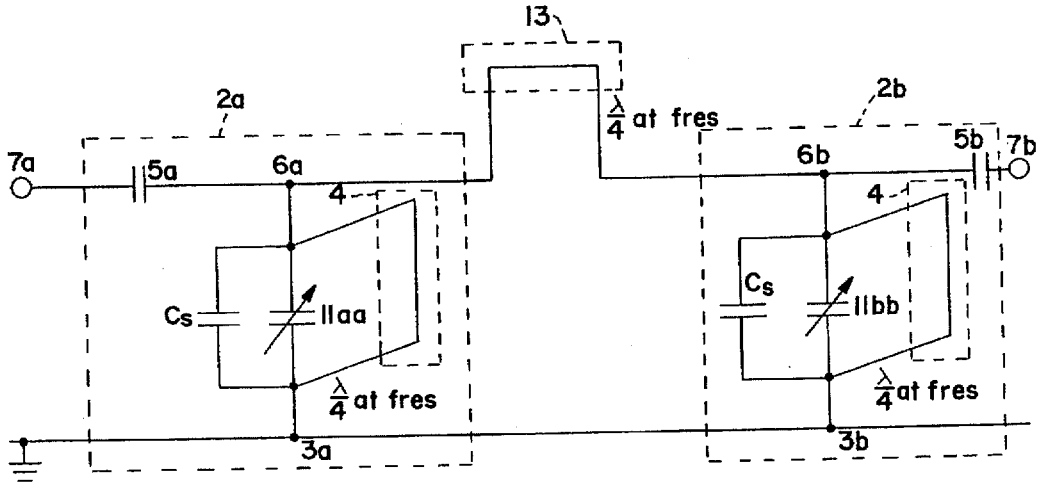

FIGS. 5A and 5B show diagrams of the equivalent circuits for the bandpass filter according to the above-described embodiment. As shown in FIG. 5A, one of the two resonators, 2*a*, operates as the input of the filter, while the other resonator, 2b, operates as the output of the filter. Each of the resonator bodies 4 is modeled as a ¼ wavelength coaxial transmission line and represented as a short circuit with an operating wavelength of $\lambda/4$ at $f_{res}$ where $\lambda$ is the full wavelength and $f_{res}$ is the resonant frequency. As noted above, the resonators 2a, 2b are electrically connected to each other through their corresponding coupling apertures 14 (see FIG. 3). In FIG. 5A, the coupling apertures 14 together constitute another ¼ wavelength coaxial transmission line 13 with an operating characteristic of $\lambda/4$ at $f_{res}$. In both FIGS. 5A and 5B, the spacer flanges 6 of the resonator 2a, 2b each create a stray capacitance $C_s$.

For purposes of describing the operation of the bandpass filter, the resonator body 4 (see FIG. 3) as shown in FIG. 5B is represented as an inductor 4a and a capacitor 4b connected in parallel between a node 6a, 3a, which is the electrical equivalent of the cavity 8, and body 4. The intermediary coaxial transmission line 13 is similarly represented by an inductor 13a and a capacitor 13b connected in parallel between the node 6a and the node 6b . The input terminal 7a represents the electrode pin 7 of the input resonator 2a, and the output terminal 7b represents the electrode pin 7 of the output resonator 2b. The arrangement of terminal 7 and cavity 8 is shown in FIG. 3. A coupling capacitor 5a that is the electrical equivalent of the capacitive insert 5 for the input resonator 2ais connected between the input terminal 7a and the node 6a. A second coupling capacitor 5b equivalent to the capacitive insert 5 for the output resonator 5b is connected between the output terminal 7b and the node 6b.

The variable capacitors 11aa connected between node 6a and ground 3a is the electrical equivalent of the tuning tab 11aon the bracket 3 variably positioned with the spacer flange 6 of the input resonator 2a and a gap 12 (See FIG. 3) between them. The variable capacitor 11bb connected between node 6b and ground 3b is the electrical equivalent of the tuning tab 11b on the bracket 3 variably positioned with the spacer flange 6 of the output resonator 2b and the gap 12 between them (See FIG. 3).

The resonator bodies 4 have pre-defined resonant frequencies by virtue of their material composition, their dimensions, and the amount of surface non-parallelism. For this embodiment, resonator bodies made by picoFarad, Inc. were used. The pre-defined resonant frequencies are determined by the particular application of the resonators. For the present invention, the resonant frequencies are pre-defined slightly higher than that required for their specific application.

In order to tune the resonant frequencies of the individual resonators, and consequently, the center frequency of the bandpass filter during manufacture for a specific application, the tuning tabs 11a, 11b are adjustably bent toward or away from their corresponding spacer flanges 6, thereby varying the distance D of the gap 12 (See FIG. 3). By varying the distance D of the gap 12, the capacitance between the tuning tabs 11a, 11b and their corresponding spacer flanges 6 is varied. Consequently, the resulting total capacitance of the variable capacitor 11aa or 11bb in parallel with the capacitor 4b of the resonator 2a or 2b, respectively, varies thereby changing the resonant frequency of the resonators.

Experimentally, the distance D of the gap 12 has been set between 0.005–0.04 inches, which can then change the resonant frequency by as much as 20 MHz. However, the exact range for varying the distance D, and consequently the range for varying the resonant frequency varies based on factors such as the dimensions of the resonators and the tuning tabs, and the material/electrical characteristics of the resonators and tuning tabs.

As noted above, the bracket 3 is formed using cold rolled steel or brass with tin plating. Brackets of other resilient yet ductile material are also useful in the present invention. By using such resilient yet ductile material, the tuning tabs 11a, 11b, if formed from the same material as the bracket 3, can be plastically deformed relatively easily, and remain bent at the selected position with a small degree of deviation. As a result, varying the resonant frequency of the resonators 2a, 2b has been found to be accurate within 1 MHz of the desired frequency.

Figure 6:
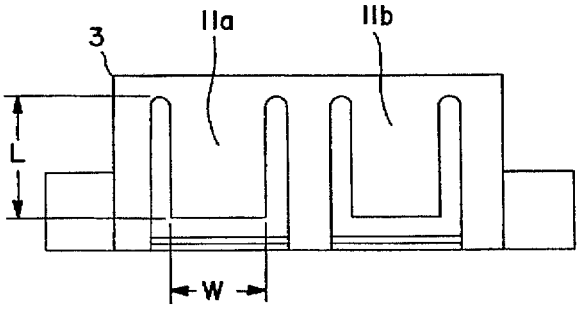
FIG. 6 shows a top view of the holding bracket illustrating the tuning tabs of the present invention.

In conjunction with varying the distance D of the gap 12, the dimensions of the tuning tabs 11a, 11b may be modified to further vary the capacitance between the tuning tabs 11a , 11b and their corresponding spacer flanges 6. For example, as shown in FIG. 6, the length L or width W of either of the tuning tabs 11aor 11b is variable. Increasing either the length L or the width W has been found to increase the frequency range for tuning the individual resonators 2a, 2b. In the above-described embodiment, the length L is variable so long as the tuning tabs 11a , 11b do not contact the electrode pin 7. Similarly, the width W is variable so long as the tabs do not contact the spacer flanges 6 of any adjacent resonators.

Modifications and variations of the above-described embodiments of the present invention are possible, as appreciated by those skilled in the art in light of the above teachings. For example, the tuning tabs 11a , 11b can be formed from a material different from the bracket 3 in order to improve the plastic deformation characteristics of the tabs. The tabs would then be electrically connected to the bracket 3 using techniques such as welding, soldering, etc. Further, other types of bandpass filters may be constructed in addition to the two-pole bandpass filter discussed as one embodiment of the invention. For example, three-pole or four-pole bandpass filters are constructed by adding the appropriate number of resonators, and electrically connecting them to the input and output resonators as would be known to one of ordinary skill in the art. Also, a single-pole bandpass filter using a single resonator with the appropriate input and output terminals would also be known to one of ordinary skill in the art.

It is therefore to be understood that, within the scope of the appended claims and their equivalents, the invention may be practiced otherwise than as specifically described.

What is claimed is:

1. A mechanically tunable bandpass filter, comprising:

a resonator;

a grounding element electrically connected to said resonator; and a mechanically deformable tuning tab proximate said resonator and said grounding element, said tuning tab forming a variable capacitor connected parallel to said resonator;

wherein the resonator comprises a resonator body, a spacer flange electrically connected to said resonator body, a capacitive element electrically connected to said spacer flange and an electrode pin electrically connected to said capacitive element and electrically isolated from said resonator body and spacer flange by said capacitive element.

2. A mechanically tunable filter according to claim 1 wherein said capacitive element is made from glass.

3. A mechanically tunable bandpass filter, comprising:

at least one resonator, said at least one resonator including a resonator body, a capacitive element electrically connected to said resonator body, and an electrode pin electrically connected to said capacitive element wherein said capacitive element electrically isolates said electrode pin from said resonator body;

a holding bracket affixed to said resonator body, said bracket being electrically connected to said resonator body;

a mechanically deformable tuning tab fixedly supported and electrically connected to said bracket at a first end thereof, wherein a second end of said tuning tab variably positioned with said resonator body forms a variable capacitance for tuning a resonant frequency of said resonator wherein said holding bracket surrounds said second end of said tuning tab; and wherein said resonator further includes an electrically conductive spacer for resiliently holding said electrode pin in said resonator body, said spacer being connected to said capacitive element, and said spacer being electrically isolated from said electrode pin by said capacitive element and electrically connected to said resonator body, whereby said tuning tab is variably positioned with respect to said spacer to form said variable capacitance for tuning said resonant frequency of said resonator.

4. A mechanically tunable bandpass filter according to claim 3, wherein said mechanically deformable tuning tab is an integral part of said bracket at said first end thereof.

5. A mechanically tunable bandpass filter according to claim 3, wherein said at least one resonator comprises at least two resonators; said at least two resonators further comprising at least an input and an output resonator wherein the input and output resonators each have a resonator body with a cylindrical cavity defined therethrough, a capacitive element electrically connected to said resonator body, and an electrode pin electrically connected to said capacitive element wherein said capacitive element electrically isolates said electrode pin from said resonator body, each of said input and output resonators having a first and second end, said input and output resonators each being supportively held by a holding bracket and electrically connected to said bracket at said first ends thereof, and being electrically connected to each other at said second ends thereof; and first and second mechanically deformable tuning tabs each having first and second ends, said first and second tuning tabs being fixedly supported and electrically connected to said bracket, wherein said first and second tuning tabs are variably positioned with respect to said resonator bodies of said input and output resonators, respectively, to form input and output variable capacitances for tuning resonator frequencies of said input and output resonators; and wherein each tuning tab is surrounded by a holding bracket.

6. A mechanically tunable bandpass filter according to claim 3 wherein said capacitive element is made of glass.

7. A mechanically tunable bandpass filter according to claim 6 wherein said spacer and said electrode pin are made of steel.

8. A tunable bandpass filter, comprising:

at least one resonator including a coaxial transmission element with first and second ends, said at least one resonator having a predetermined resonant frequency, a coupling capacitor comprising a conductive spacer flange and a dielectric capacitive element and having first and second ends, and an electrode capacitively connected to said first end of said coupling capacitor, said coupling capacitor being electrically connected at said second end to said first end of said coaxial transmission element;

a grounding element electrically connected to said second end of said coaxial transmission element, and connectable to ground; and a variably deformable tuning tab having first and second ends, said tuning tab being electrically connected at said first end to said grounding element, wherein said second end of said tuning tab is variably positioned with respect to said first end of said coaxial transmission element thereby forming a variable capacitor parallel to said resonator, for tuning said predetermined resonant frequency of said resonator.

9. A tunable bandpass filter according to claim 8, wherein said at least one resonator comprises at least two resonators; said at least two resonators further comprising at least input and output resonators each having a coaxial transmission element with first and second ends, each of said input and output resonators having a predetermined resonant frequency, a coupling capacitor comprising a conductive spacer flange and a dielectric capacitive element and having first and second ends, and an electrode capacitively connected to said first end of said coupling capacitor, said coupling capacitor being electrically connected at said second end to said first end of said coaxial transmission element, said input and output resonators each being electrically connected to said grounding element at said first ends thereof, said input and output resonators being electrically connected to each other at second ends thereof, said grounding element being electrically connectable to ground; and first and second mechanically deformable tuning tabs, each of said tuning tabs having first and second ends, and each said tuning tab being fixedly supported and electrically connected to said grounding element at first ends thereof, wherein said second ends of said first and second tuning tabs are variably positioned with respect to said first ends of said coaxial transmission elements of said input and output resonators, respectively, thereby forming input and output variable capacitors parallel to said input and output resonators, respectively, for tuning said resonant frequencies thereof.

10. A tunable bandpass filter according to claim 8, wherein said grounding element includes a holding bracket affixed to said resonator and surrounding said tuning tab.

11. A device for tuning a resonant frequency of a bandpass filter, said bandpass filter including at least one resonator, said at least one resonator including a resonator body, a coupling capacitor comprising an electrically conductive spacer flange electrically connected to said resonator body and a dielectric element, and an electrode pin electrically connected to said dielectric element of said coupling capacitor and electrically isolated from said resonator body and said spacer flange, and a holding bracket affixed to said resonator body, said bracket being electrically connected to said resonator body, said device comprising:

a mechanically deformable tuning tab fixedly supported and electrically connected to said bracket at a first end thereof, wherein a second end of said tuning tab variably positioned with respect to said spacer flange forms a variable capacitor connected parallel to said resonator, for tuning a resonant frequency of said resonator; and wherein said holding bracket surrounds said second end of said tuning tab.

12. A device for tuning a resonant frequency of a bandpass filter according to claim 11, wherein said mechanically deformable tuning tab is an integral part of said bracket at a first end thereof.

13. A device for tuning a resonant frequency of a bandpass filter according to claim 11 wherein said capacitor is made of glass.

14. A bandpass filter component comprising:

a resonator body having a cylindrical cavity;

an electrode pin having two ends;

a capacitive element made of glass connected to and cylindrically disposed about said electrode pin; and an electrically conductive cylindrical spacer flange connected to and cylindrically disposed about said capacitive element;

wherein said spacer flange is electrically isolated from said electrode pin;

and wherein said cylindrical spacer flange holds said electrode pin in place within said cylindrical cavity and further wherein said electrode pin is electrically isolated from said resonator body.

15. The bandpass filter component of claim 14 wherein said spacer flange and said electrode pin are made of steel.

* * * * *